US006341638B1

(12) United States Patent
Thompson et al.

(10) Patent No.: US 6,341,638 B1
(45) Date of Patent: Jan. 29, 2002

(54) AUTOMATIC DEPLOYING RETRACTABLE AWNING

(75) Inventors: Scott P. Thompson, Longmont; Grant G. Greene, III, Lafayette; Kenneth M. Faller, Thornton; Brian J. Hodd, Arvada; Timothy C. Titus, Westminster; Larry Cable, Brighton, all of CO (US)

(73) Assignee: Carefree/Scott Fetzer Co., Broomfield, CO (US)

( * ) Notice: Subject to any disclaimer, the term of this patent is extended or adjusted under 35 U.S.C. 154(b) by 0 days.

(21) Appl. No.: 09/586,945

(22) Filed: Jun. 2, 2000

Related U.S. Application Data

(60) Provisional application No. 60/139,051, filed on Jun. 10, 1999, and provisional application No. 60/166,856, filed on Nov. 22, 1999.

(51) Int. Cl.[7] ..... E04F 10/06

(52) U.S. Cl. ..... 160/67; 160/71; 160/80

(58) Field of Search ..... 160/66, 67, 70, 160/71, 79, 80

(56) References Cited

U.S. PATENT DOCUMENTS 4,530,389 A * 7/1985 Quinn et al.
4,719,954 A * 1/1988 Curtis et al.
5,307,856 A 5/1994 Murray ..... 160/70
5,832,978 A * 11/1998 Kroner
5,896,908 A * 4/1999 Kaun
6,006,811 A * 12/1999 Brutsaert
6,098,693 A * 8/2000 Frey, Jr.

FOREIGN PATENT DOCUMENTS

JP 290863 * 11/1989
JP 291346 * 3/1990

* cited by examiner

*Primary Examiner*—Blair M. Johnson
(74) *Attorney, Agent, or Firm*—Dorsey & Whitney LLP

(57) ABSTRACT

A retractable awning adapted to be moved between extended and retracted positions includes a pair of support arms and a pair of rafter arms each of which can be extended or retracted with the awning. A motor rotates a drive shaft and a roll bar to which an awning sheet is connected so that energization of the motor causes the awning to be wrapped around the roll bar when the awning is being retracted or unwrapped from the roll bar when the awning is being extended. A belt system is disposed in each support arm which causes the support arm to extend or retract depending upon the direction of rotation of the motor so that the arms are extended simultaneously with the unwrapping of the awning sheet from the roll bar or retracted simultaneously with wrapping of the awning sheet around the roll bar. A rigid or alternatively resilient brace extends between each support arm and an associated rafter arm for holding the rafter arms in an extended position as the awning reaches a fully extended position. An embodiment of the invention is also disclosed wherein the awning automatically retracts in inclement weather conditions.

33 Claims, 16 Drawing Sheets

AUTOMATIC DEPLOYING RETRACTABLE AWNING

CROSS-REFERENCE TO RELATED APPLICATIONS

The subject application claims priority to provisional application Ser. No. 60/139,051, filed Jun. 10, 1999, entitled "Powered Retractable Awning" and to provisional application Ser. No. 60/166,856, filed Nov. 22, 1999, also entitled "Powered Retractable Awning."

BACKGROUND OF THE INVENTION

1. Field of the Invention

The present invention relates generally to retractable awnings and more particularly to an automated or powered retractable awning that will extend and retract under its own power.

2. Description of the Relevant Art

Retractable awnings have been in use for many years, with early uses being primarily as covers for windows, doors and the like. More recently, retractable awnings have been designed for use on mobile structures such as recreational vehicles and mobile homes, and, accordingly, out of necessity, the awnings have needed to include more sophisticated systems of operation and for retaining the awnings in either retracted or extended positions. Further, awnings for recreational vehicles and mobile homes are fairly long so as to extend along a substantial portion of the side of the vehicle, and, accordingly, they are relatively heavy and are sometimes difficult to manipulate.

Typically, a retractable awning includes an awning sheet that is secured along one edge to the side of the recreational vehicle or the like, with the opposite edge being secured to a roll bar about which the awning sheet can be wrapped. The roll bar is rotatably supported at opposite ends by support arms which are typically telescoping in nature and have an inner end affixed to the side wall of the vehicle at a location beneath the connection of the awning sheet to the vehicle. Rafters are also normally provided which extend from the roll bar to a location on the side of the vehicle adjacent to the connection of the awning sheet to the vehicle, with the rafters typically being used to retain the awning sheet in a taut condition. The awning is moved from a retracted position adjacent to the side of the vehicle to an extended position by allowing the support arms to pivot about their connection to the side of the vehicle thereby allowing the awning sheet to unroll from the roll bar. After the awning sheet has been fully extended, the rafters are locked in position to retain a taut condition of the awning sheet, and subsequently, the support arms are telescopically extended causing the roll bar to move upwardly to a desired elevation.

The extension of the support arms has traditionally been difficult due to the heavy weight of the awning structure. The problem is compounded by the fact that many recreational vehicles are owned and operated by elderly individuals who do not always have the strength of younger individuals, and many times the elderly have some difficulty in extending the awning to a desired elevation.

It will be appreciated from the above that, while awnings are desirable not only in the recreational vehicle and mobile home industry but also in permanent residences, they have traditionally been difficult to operate thereby discouraging use of the awning. Automated awnings have, therefore, been desirable and attempts to develop a reliable automatic awning have, therefore, been made.

It is to overcome shortcomings in manually operated retractable awnings and to provide a dependable automatic awning that the present invention has been developed.

SUMMARY OF THE INVENTION

The retractable awning of the present invention, like most retractable awnings of its type, has a flexible awning sheet or canopy that is secured along one edge to a support structure, such as a recreational vehicle, mobile home, permanent residence, or the like. The opposite edge of the awning sheet is secured to a roll bar. When the awning is moved from an extended to a retracted position, the awning sheet is wrapped around the roll bar and, of course, when the awning is moved from a retracted position to the extended position the awning sheet is unwrapped from the roll bar. The roll bar is rotatably supported at the outer ends of a pair of extendable support arms which are pivotally anchored at an inner end to the support surface at a relatively low location on the support surface. When the awning is retracted, the support arms and the roll bar that is supported thereby are positioned immediately adjacent to the support surface but as the awning is extended, the upper ends of the support arms are allowed to pivot or swing away from the support surface thereby moving the roll bar therewith and extending the awning sheet as it is unwrapped from the roll bar.

A rafter arm is associated with each support arm and has an inner end pivotally connected to the support surface at a relatively high location on the support surface, with the other end of the rafter arm being pivotally and operably connected to the outer end of the support arm adjacent to the connection of the roll bar to the support arm. The roll bar contains a drive shaft and the drive shaft supports on one end thereof a reversible drive motor which rotates the drive shaft in one direction or another depending upon its selective direction of energization. In other words, when the motor is energized to rotate the drive shaft in one direction, it allows the awning sheet to be unwrapped from the roll bar while, when it is energized to rotate the drive shaft in the opposite direction, it effects a wrapping of the awning sheet about the roll bar.

The support arm and rafter arm at one end of the roll bar are identical to the support arm and rafter arm at the opposite end of the roll bar, with the support arm including inner and outer support arm sections which are slidably and telescopically interconnected so that the length of the support arm can vary as the awning is extended or retracted. The rafter arm similarly has an inner section and an outer section, but the inner and outer sections, while being nestable relative to each other in a retracted position, are pivotally interconnected at one end, with the opposite ends being connected to the support surface and support arm respectively. Accordingly, as the awning is moved from a retracted to an extended position, the rafter arms unfold from nested positions to extended positions wherein the inner and outer segments are substantially longitudinally aligned and when the awning is retracted, the inner and outer sections fold or pivot about their pivotal connection until the inner and outer sections are nested one within the other.

A lock arm operably connects each rafter arm to an associated support arm adjacent the outer ends of the rafter arm and support arm and serves as a brace between the associated support and rafter arms when the awning is extended.

At each end of the drive shaft adjacent to the opposite ends of the roll bar and in alignment with an associated support arm, a drive spool supports a flexible extension belt, which might be nylon webbing, substantially inextensible rubber, or the like. The drive belt extends along the length of the outer section of the support arm toward the inner end of the outer section of the support arm where it is extended around an idler spool which allows the direction of the belt to be reversed. After passing around the idler spool, a free end of the extension belt is anchored to an outer end of the inner support arm segment. The extension belt is adapted to be wrapped around the drive spool or unwrapped therefrom as the awning is moved between retracted and extended positions and actually partially affects the extension and retraction of the awning. When the awning is retracted, each support arm is also retracted into its minimum length, with the outer support arm segment being telescopically received within the inner segment. When the extension belt is fully unwrapped from the drive spool, it substantially extends from one end of the shortened support arm to the other. When the drive spool is rotated by the motor in a direction to wrap the extension belt around the drive spool, the effective length of the belt is shortened as it extends along the support arm thereby pulling the outer segment of the support arm axially and outwardly along the inner segment so that the overlap of the inner and outer segments is reduced and the overall length of the support arm is increased. Of course, as the length of the support arm is increased, and the awning sheet is unrolled from the roll bar, which is happening simultaneously, the roll bar swings or pivots away from the support surface and when doing so, simultaneously unfolds the rafter arms. Energization of the drive motor on the roll bar thereby causes the awning to extend or retract and when the support arms are fully extended or retracted and the awning sheet is fully unwrapped from or wrapped onto the roll bar, respectively, an overload switch on the electric motor de-energizes the motor.

The lock arm, which operably interconnects each rafter arm with its associated support arm, serves to retain the rafter arm in a fully extended position and prevents the rafter arm from collapsing or pivoting about the pivotal connection between the inner and outer rafter arm sections by forming a brace between the support arm and the rafter arm. A slide member, which is secured to the extension belt at a preselected location, actually engages one end of the lock arm immediately prior to the awning being fully extended and forces that end of the lock arm to slide a short distance along the length of the support arm and in doing so causes the opposite end of the lock arm to force the rafter arm upwardly until the inner and outer rafter arm sections are substantially longitudinally aligned. A stop member at the pivotal connection between the inner and outer rafter arm sections in one embodiment actually prevents a perfect alignment of the rafter arms and thereby prevents an over-centered relationship of the two rafter arms so that when the awning is retracted the rafter arms automatically collapse in a downward and desired direction. When the awning is to be retracted, the motor is energized to rotate the drive shaft in an opposite direction which causes the awning sheet to be wrapped around the roll bar and causes the extension belt to unwind from the drive spool, which moves the slide member away from the associated end of the lock arm, thereby allowing the rafter arm to collapse in a downward direction. Also, as the extension belt is unwound from the drive spool, the inward swinging movement of the roll bar causes the inner and outer sections of the support arms to telescopically collapse thereby shortening the effective length of the support arms. Once the awning is fully retracted with the roll bar and support arms immediately adjacent to the support surface, the overload switch on the electric motor de-energizes the motor to prevent further rotation of the roll bar.

It can thereby be seen that simply through energization of the motor in one direction or another, the awning is caused to be extended or retracted as desired and without manual assistance thereby providing an awning that is easy to operate through manipulation of an electrical switch.

In one embodiment of the awning, another electrical switch detects movement of the awning when it is extended, which might be caused by inclement weather, and energizes the electric motor to automatically retract the awning to avoid damage to the awning which might otherwise be caused by the inclement weather.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
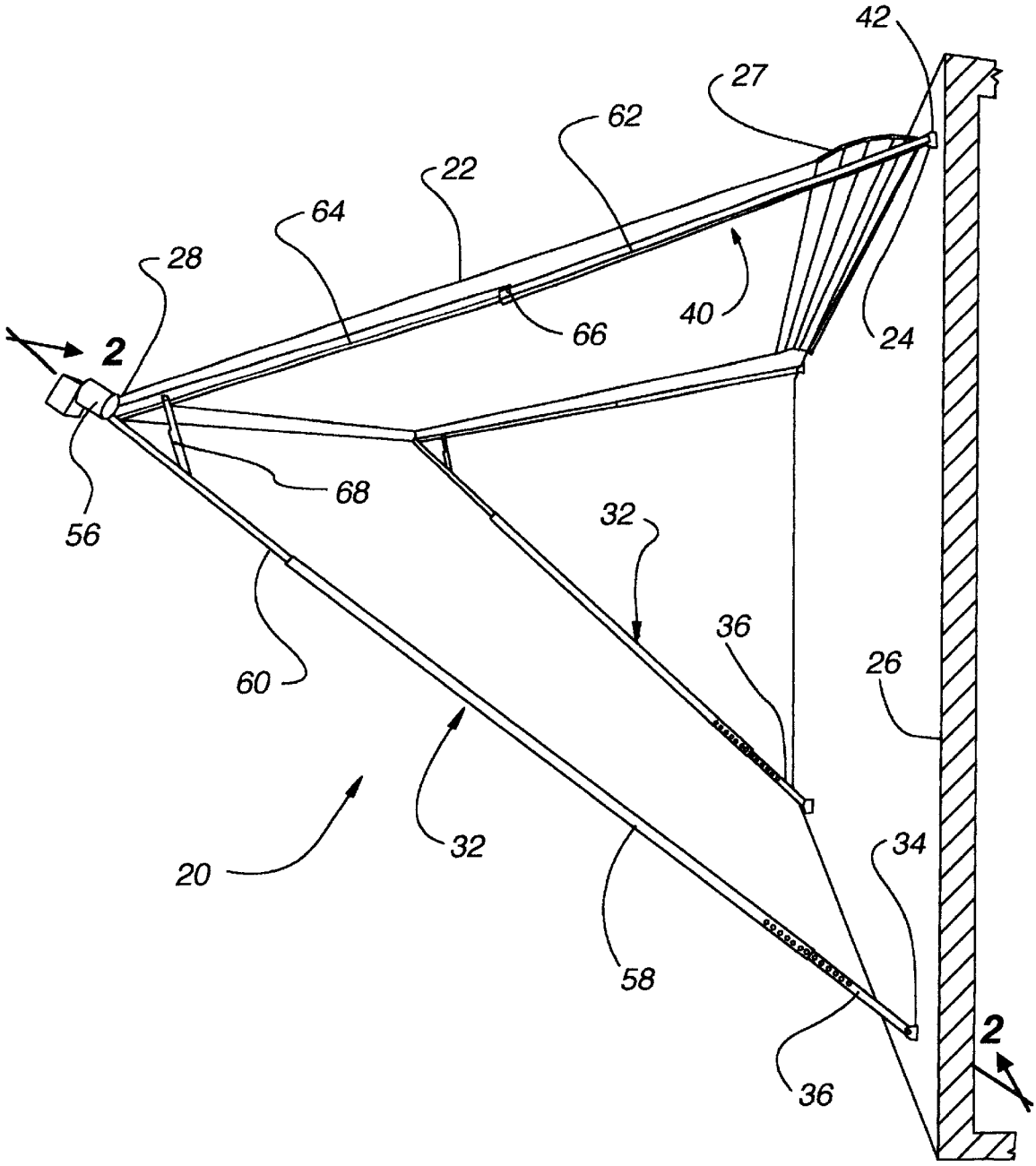
FIG. 1 is a fragmentary perspective view of a first embodiment of the awning of the present invention.
Figures 2, 2A:
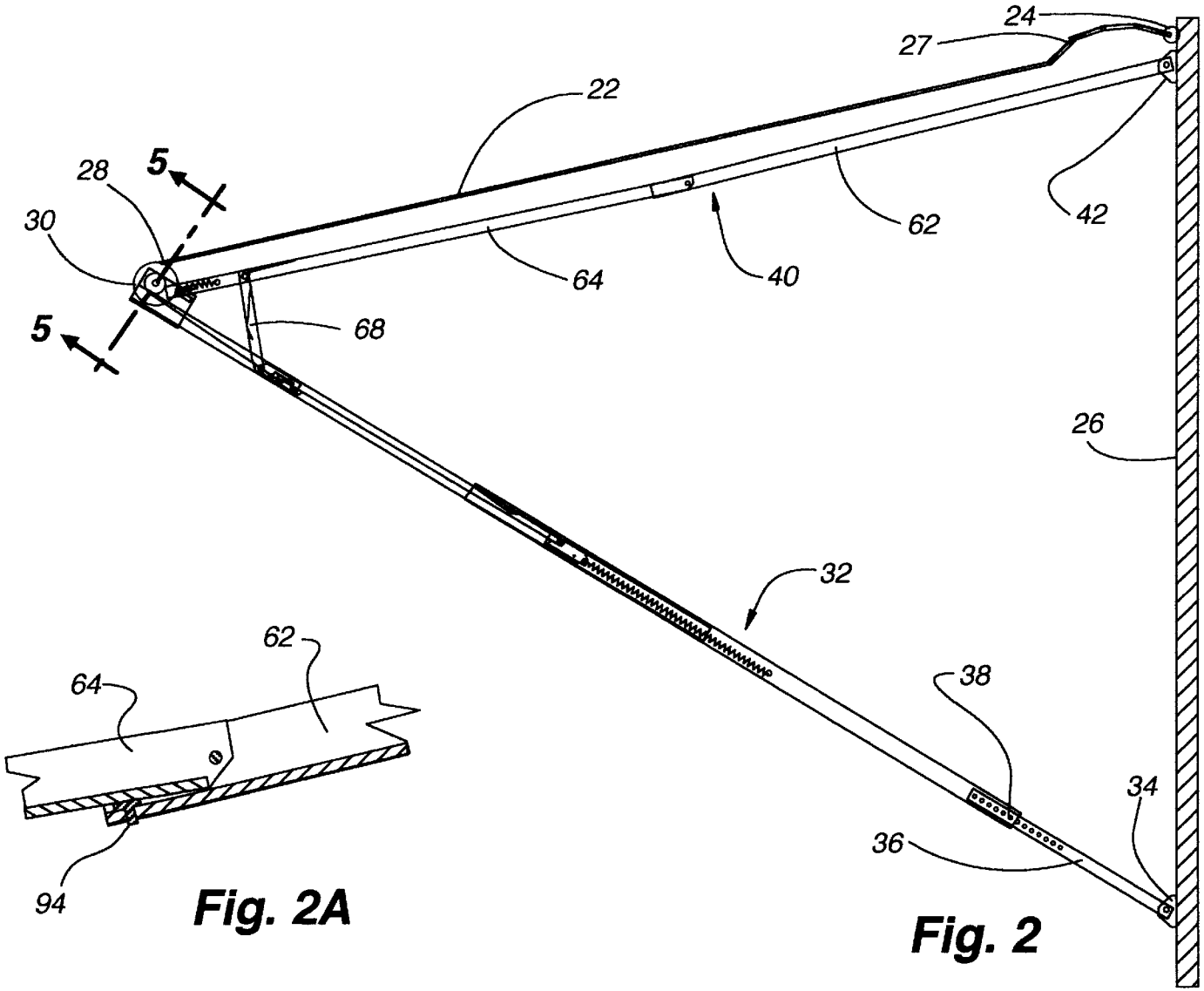
FIG. 2 is a section taken along line 2—2 of FIG. 1.
FIG. 2A is an enlarged fragmentary vertical section taken through the rafter arm at the connection between the inner and outer rafter arm segments.

In a first embodiment of the retractable awning 20 of the present invention as seen in FIG. 1, the awning has a flexible awning sheet or canopy 22 that is secured along one edge 24 to a support structure 26, such as a recreational vehicle, mobile home, permanent residence, or the like via an articulated metal slat weather protective body 27 which are well known in the art. The opposite edge 28 of the awning sheet is secured to a cylindrical roll bar 30. When the awning is moved from an extended to a retracted position, the awning sheet is wrapped around the roll bar and, of course, when the awning is moved from a retracted position to the extended position the awning sheet is unwrapped from the roll bar.

Figure 5:
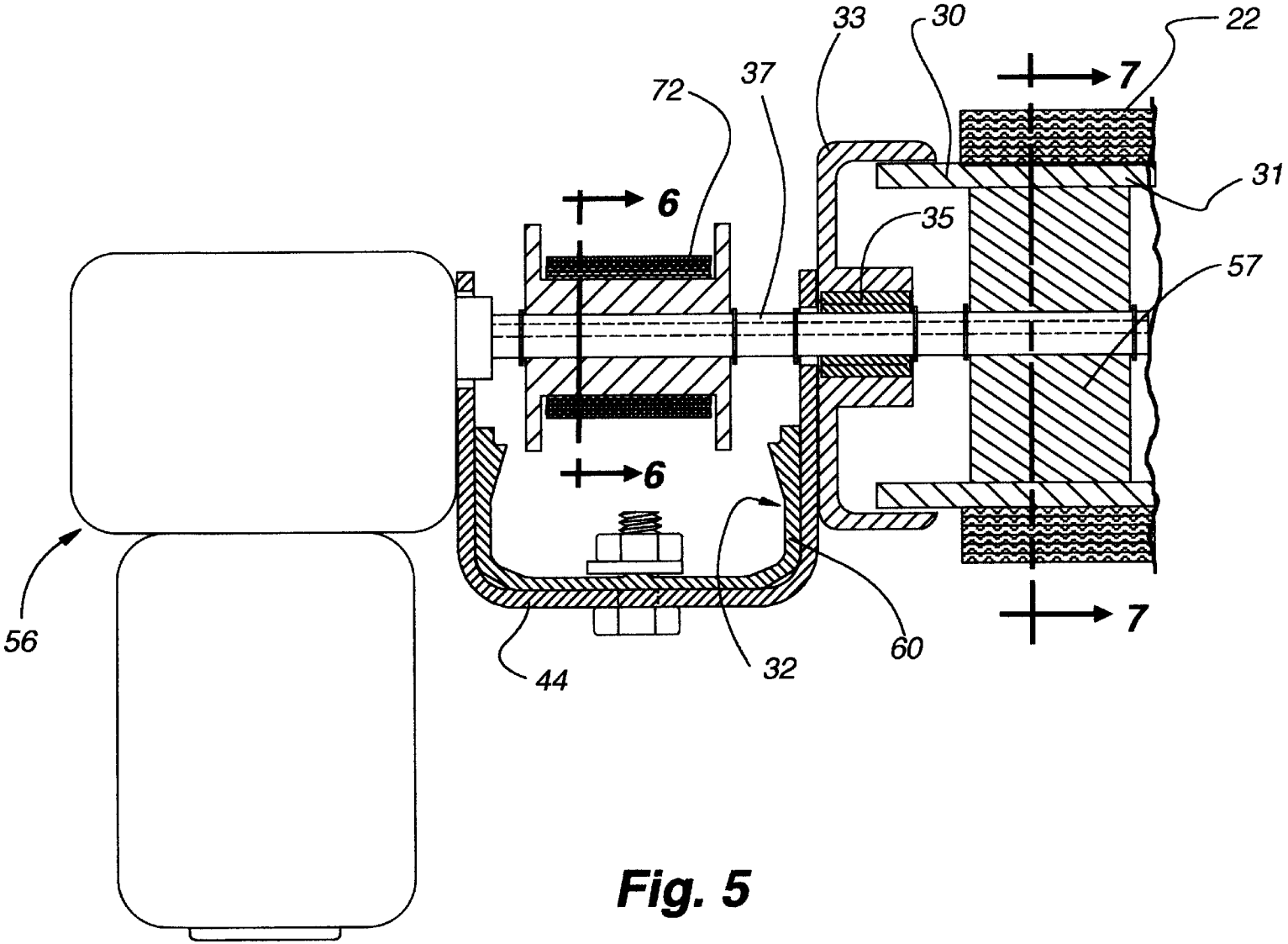
FIG. 5 is an enlarged section taken along line 5—5 of FIG. 2.
Figure 7:
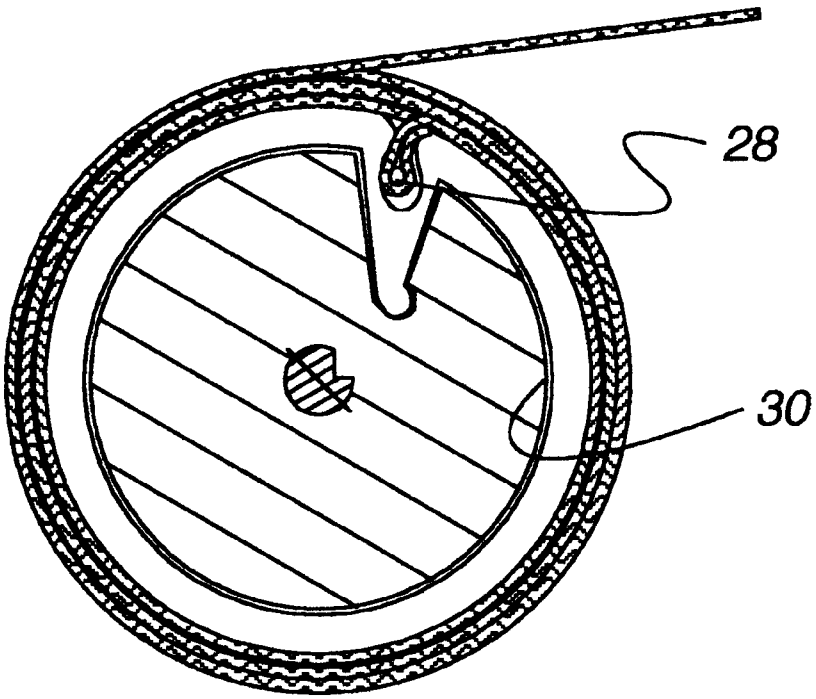
FIG. 7 is a section taken along line 7—7 of FIG. 5.
Figure 6:
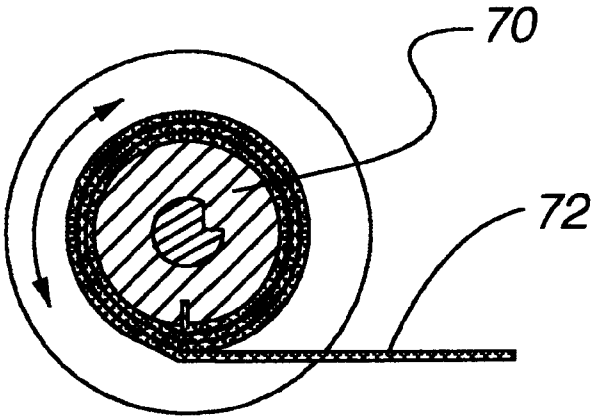
FIG. 6 is a section taken along line 6—6 of FIG. 5.
Figure 9:
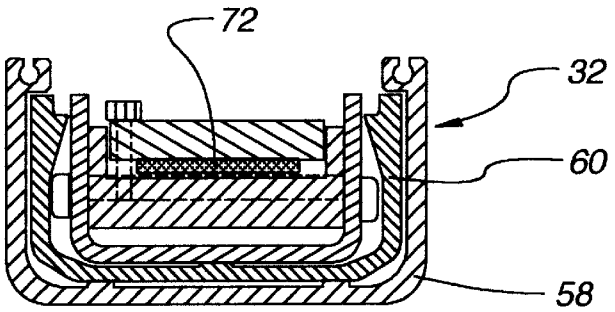
FIG. 9 is an enlarged section taken along line 9—9 of FIG. 4.
Figure 11:
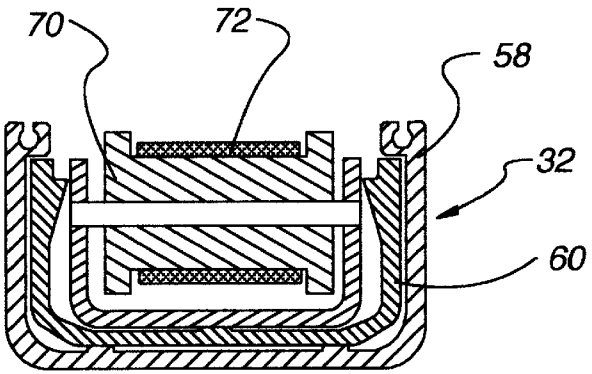
FIG. 11 is an enlarged section taken along line 11—11 of FIG. 4.
Figure 8:
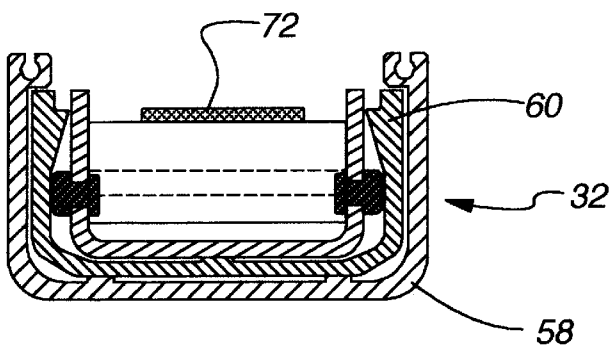
FIG. 8 is an enlarged section taken along line 8—8 of FIG. 4.
Figure 10:
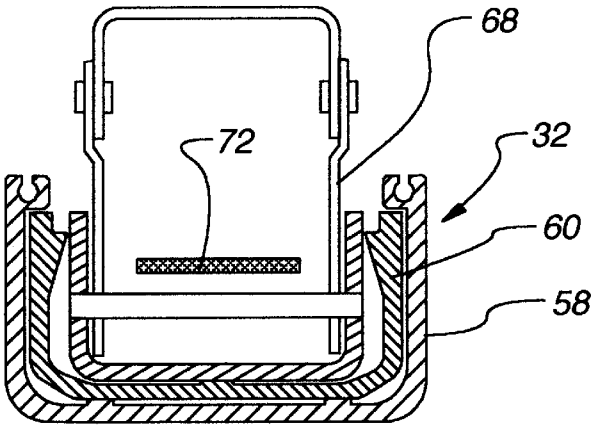
FIG. 10 is an enlarged section taken along line 10—10 of FIG. 4.
Figure 12:
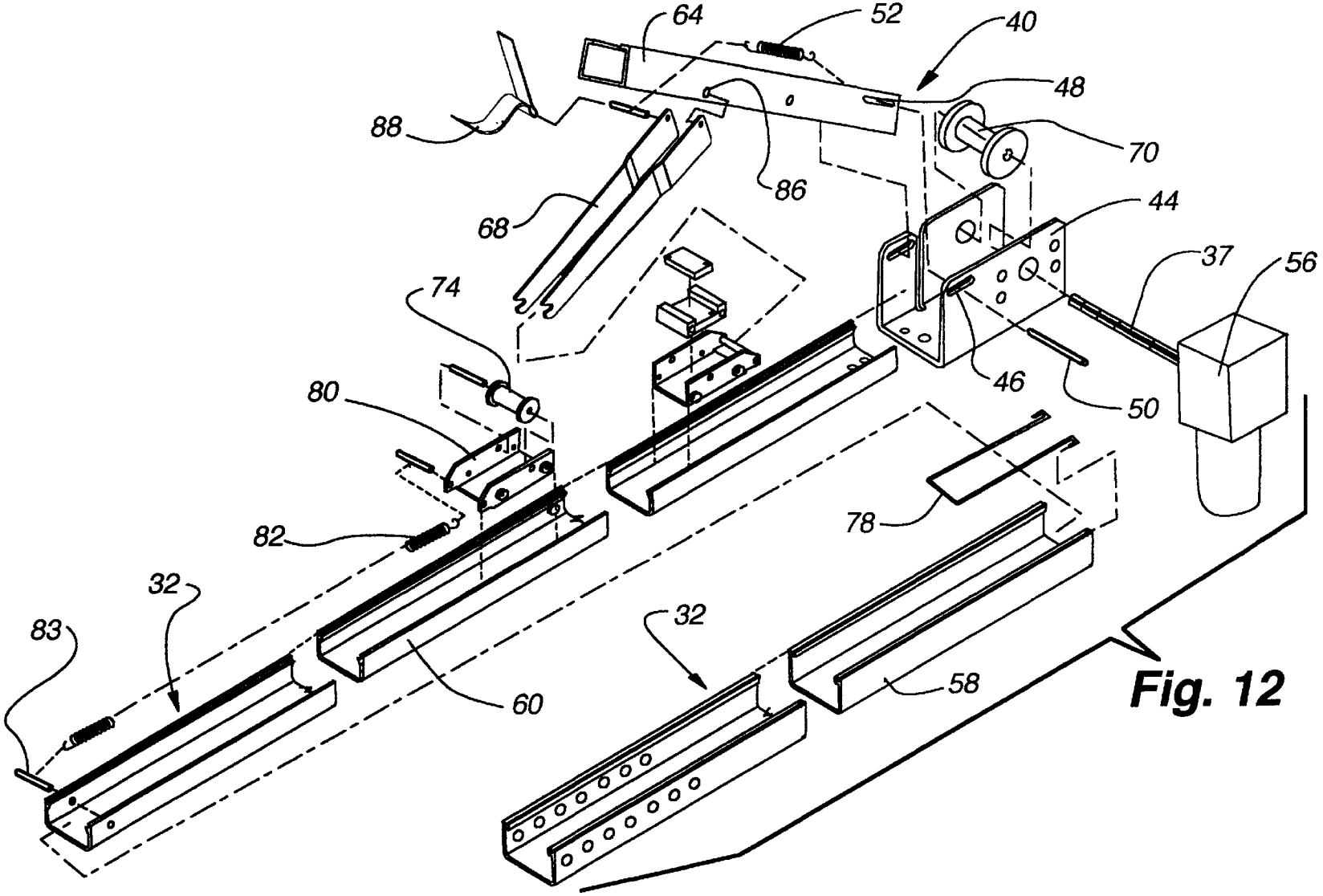
FIG. 12 is a fragmentary exploded isometric view showing various components of the awning.

The roll bar as best seen in FIG. 5 includes a cylindrical tube 31 having end caps 33 at each end. The end caps include bearings 35 for rotatably supporting a drive shaft 37 that protrudes from opposite ends of the roll bar. As will be explained in more detail later, the drive shaft pivotally and operably supports the outer ends of a pair of telescopically extendable support arms 32 which are pivotally anchored at an inner end to a bracket 34 on the support structure at a relatively low location on the support structure. The bracket has an elongated rod 36 pivotally mounted thereon which slidably protrudes into the inner end of the associated support arm 32 and is secured thereto with a transverse pin 38 that is selectively positionable in an opening through the support arm so that the effective length of the support arm can be manually selected and adjusted in a conventional manner. When the awning is retracted, the support arms and the roll bar that is supported thereby are positioned immediately adjacent to the support structure 26 (not shown) but as the awning is extended, the upper ends of the support arms are allowed to pivot or swing away from the support surface thereby moving the roll bar therewith and extending the awning sheet as it is unwrapped from the roll bar.

A rafter arm 40 (FIGS. 1 through 4) is associated with each support arm 32 and has an inner end pivotally connected to a bracket 42 on the support structure 26 at a relatively high location on the support structure, with the outer end of the rafter arm being pivotally and operably connected to the outer end of the associated support arm adjacent to the connection of the roll bar to the support arm. The outer ends of the support arms have a bracket 44 (FIGS. 3, 4 and 5) secured thereto with aligned slots 46 extending parallel to the length of the support arm. Similarly, the associated rafter arm has a pair of aligned slots 48 extending along its length adjacent to the outer end thereof and an anchor pin 50 is slidably disposed in the slots of both the rafter arm 40 and the bracket 44. A coil spring 52 mounted in the rafter arm biases the anchor pin toward the inner end of the rafter arm or toward the support structure 26. This arrangement allows for a sloppy connection of the rafter arm to the support arm which is desirable inasmuch as there is only a small tolerance in the operation of the awning and the sloppy connection provides an automatic adjustment for purposes that will become more clear later.

The drive shaft 37 protrudes, at one end, beyond the associated support arm 32 and is drivingly engaged with a reversible electric motor 56, as seen in FIGS. 1 and 5. The drive motor rotates the drive shaft in one direction or another depending upon its selective direction of energization which is effected by a manually operable switch (not shown). The drive shaft is keyed to a plug 57 (FIG. 5) secured in the associated end of the cylindrical tube 31 for unitary rotation with the cylindrical tube. When the motor is energized to rotate the drive shaft in one direction, it allows the awning sheet 22 to be unwrapped from the roll bar while, when it is energized to rotate the drive shaft in the opposite direction, it effects a wrapping of the awning sheet about the roll bar.

The support arm 32 and rafter arm 40 at one end of the roll bar is identical to the support arm and rafter arm at the opposite end of the roll bar, with the support arms including inner and outer support arm sections 58 and 60 respectively, which are slidably and telescopically interconnected so that the length of the support arms can vary as the awning is extended or retracted. The rafter arm similarly has an inner section 62 and an outer section 64, which are nestable relative to each other when the awning is retracted. The outer end of the inner section 62 is pivotally connected at 66 to the inner end of the outer section 64. Also, the inner end of the inner section 62 is pivotally connected to the bracket 42 on the support surface and the outer end of the outer section 64 is pivotally connected to the outer end of the associated support arm 32 as described above. Accordingly, as the awning is moved from a retracted to an extended position, the rafter arms unfold from a nested position to an extended position wherein the inner and outer sections 62 and 64 are substantially longitudinally aligned (FIG. 1) and when the awning is retracted, the inner and outer sections fold or pivot about their pivotal connection until the inner and outer sections are nested one within the other.

A lock arm 68 (FIGS. 1 through 4 and 12) operably connects each rafter arm 40 to an associated support arm 32 adjacent the outer ends of the rafter arm and the support arm and serves as a brace between the associated support and rafter arms when the awning is extended.

Figure 3:
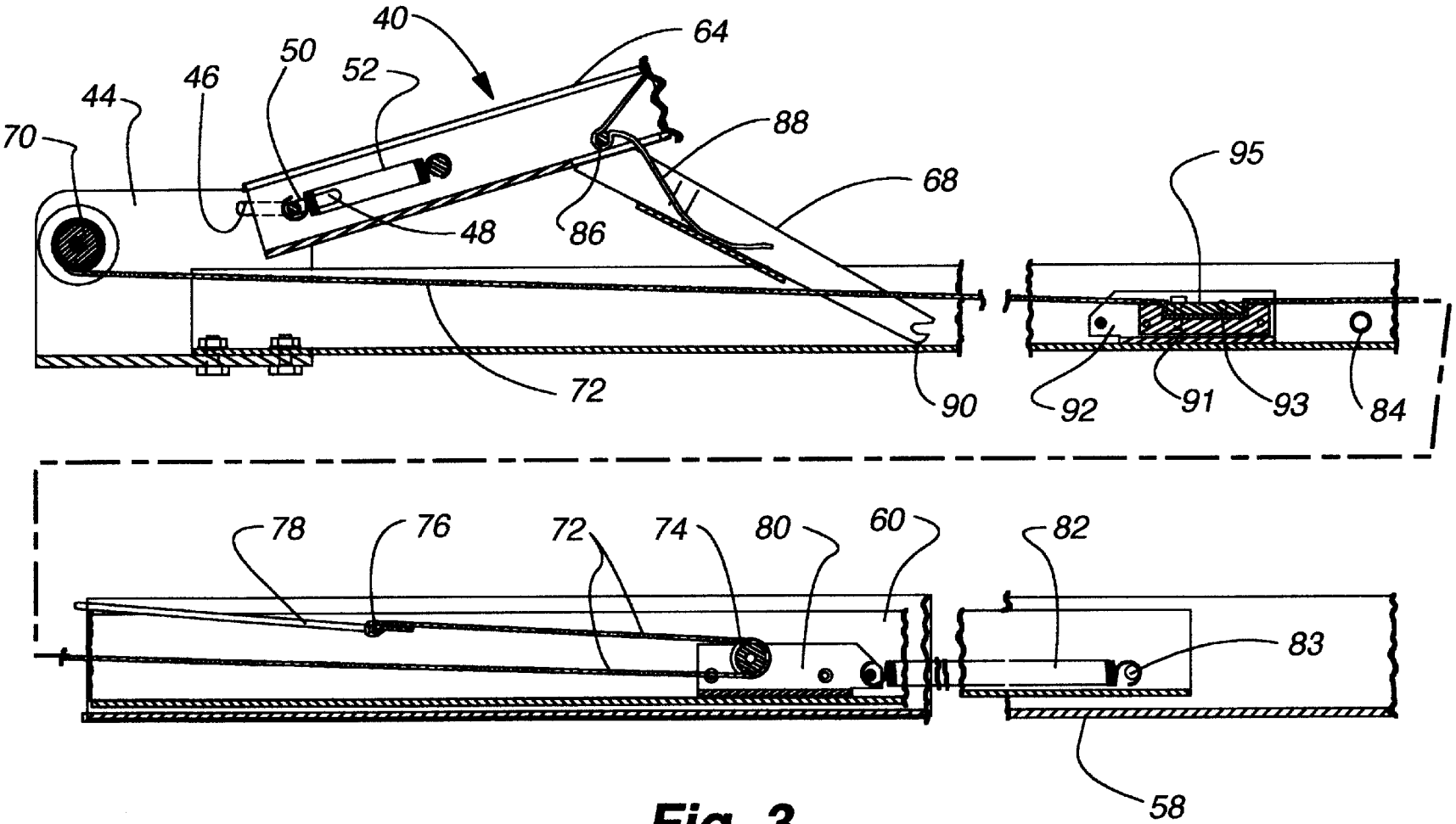
FIG. 3 is an enlarged fragmentary vertical section taken through a support arm and a part of a rafter arm.
Figure 4:
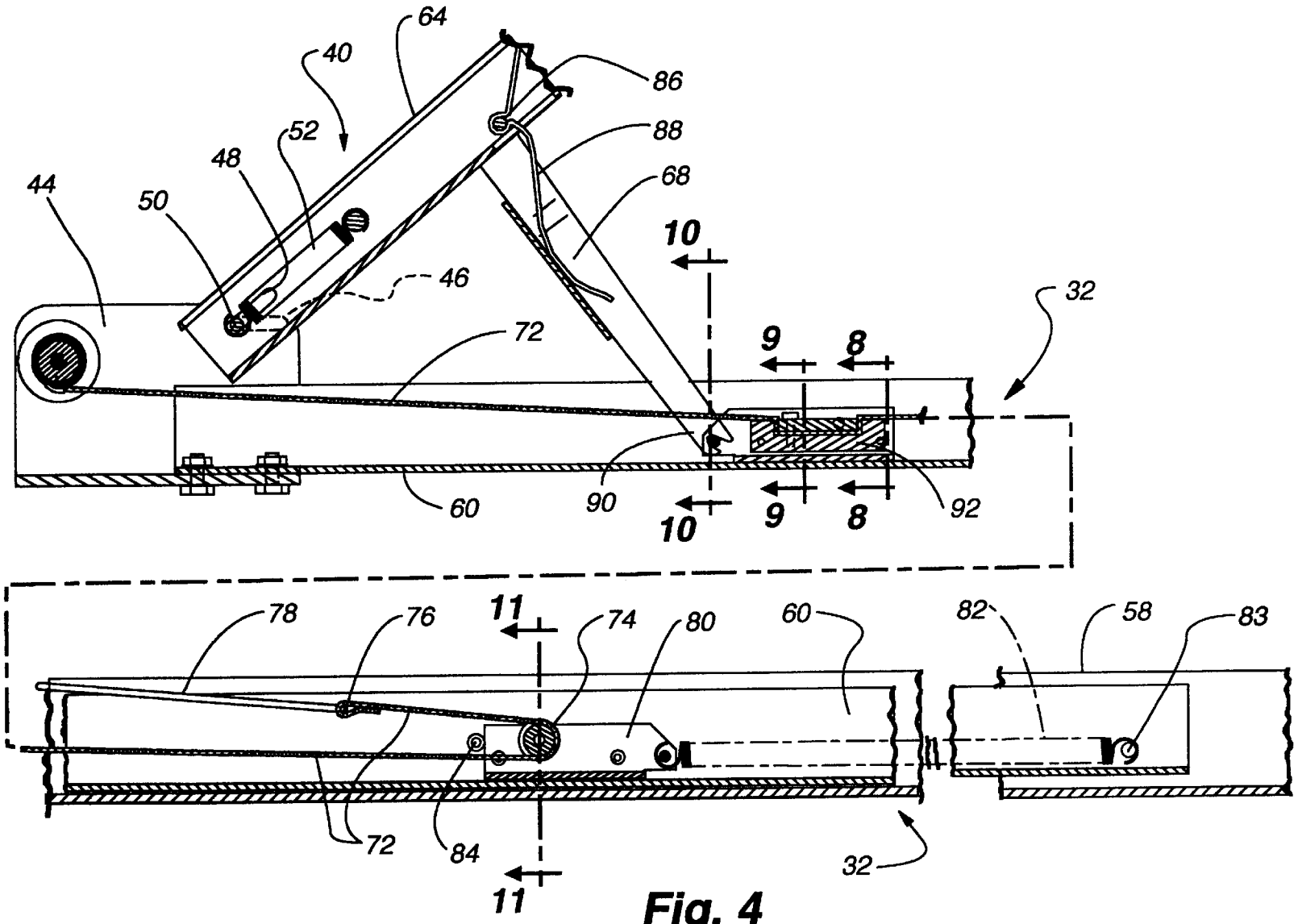
FIG. 4 is a fragmentary vertical section similar to FIG. 3 with the components in a different position.

At each end of the drive shaft 54 (FIG. 5) adjacent to the opposite ends of the roll bar 30 and in alignment with an associated support arm 32, a drive spool 70, keyed to the drive shaft, supports a flexible but non-stretchable extension belt 72, which might be nylon webbing, substantially non-stretchable rubber, or the like. As best seen in FIGS. 3 and 4, the drive belt extends inwardly along the length of the outer section 60 of the support arm toward the inner end of the outer section of the support arm where it passes around an idler spool 74 which allows the direction of the belt to be reversed. After passing around the idler spool, a free end 76 of the extension belt is anchored to a U-shaped clip 78 mounted on the outer end of the inner section 58 of the support arm. The extension belt is adapted to be wrapped around the drive spool or unwrapped therefrom as the awning is moved between retracted and extended positions. The idler spool is rotatably mounted on a slide 80 slidably disposed in the outer section 60 of the support arm and the slide is biased inwardly toward the support structure 26 by a coil spring 82 that is secured at its outer end to the slide 80 and at its inner end to an anchor pin 83 on the outer section of the support arm. The idler spool thereby maintains tension in the extension belt. A stop 84 (FIGS. 3 and 4) on the outer section 60 limits movement of the slide outwardly as the extension belt is being wrapped around the drive spool 70.

When the awning is retracted, each support arm 32 is also retracted into its minimum length, with the outer support arm section 60 being telescopically received within the inner section 58 as probably best seen in FIGS. 8 through 11. When the extension belt 72 is fully unwrapped from the drive spool 70, it extends substantially from one end of the shortened support arm to the other. When the drive spool is rotated by the drive motor 56 in a direction to wrap the extension belt around the drive spool, the effective length of the belt is shortened as it extends along the outer section 60 of the support arm thereby pulling the outer section of the support arm axially and outwardly along the inner section 58 so that the overlap of the inner and outer sections is reduced and the overall length of the support arm is increased. Of course, as the length of the support arm is increased, and the awning sheet is unrolled from the roll bar, which is happening simultaneously, the roll bar swings or pivots away from the support structure 26 and when doing so, simultaneously unfolds the rafter arms 40. When the support arms are fully extended and the awning sheet is fully unwrapped from the roll bar, a conventional overload switch built into the electric motor de-energizes the motor.

When the roll bar initially begins to unroll the canopy from its retracted position, the extension belt 72 starts its initial wrap around the drive spool 70 and the slide 80 that carries the idler spool 74 initially slides outwardly along the outer section 60 of the support arm until it engages the stop 84. Prior to engaging the stop, the awning sheet is unrolling but the support arms are not extending. The support arms do not begin extending until the slide 80 engages the stop.

Each lock arm 68, which operably interconnects its associated rafter arm 40 with its associated support arm 32, serves to retain the rafter arm in a fully extended position when the awning is fully extended and prevents the rafter arm from collapsing or pivoting about the pivotal connection between the inner and outer rafter arm sections 62 and 64, respectively, by forming a brace between the support arm and the rafter arm. The outer end of the lock arm is pivotally connected at 86 to an associated rafter arm 40 near the outer end of the rafter arm and a leaf spring 88 mounted on the rafter arm biases the inner end of the lock arm downwardly so that its inner free end 90 slidably engages the associated support arm 32 (FIG. 3) in closely spaced relationship with the extension belt 72.

A slide engagement member 92 (FIGS. 3 and 4) is secured to the extension belt 72 at a preselected location along its length and is adapted to engage the free end 90 of the lock arm 68 immediately prior to the awning being fully extended. The slide engagement member has a main body 91 having a groove 93 in the top thereof and a removable cap 95 that is releasably securable in the groove 93 so as to trap the extension belt in the groove and fix the position of the slide engagement member on the extension belt. As the slide engagement member is pulled outwardly by the belt 72 and engages the free end 90 of the lock arm, it forces the free end of the lock arm to slide a short distance outwardly along the length of the support arm and in doing so causes the opposite end of the lock arm to force the outer section 64 of the rafter arm 40 upwardly until the inner and outer rafter arm sections are substantially longitudinally aligned, as seen in FIG. 1. The sloppy connection of the rafter arms 40 to the support arms 32 is important in that in the event the engagement slide, for example, is not precisely positioned along the length of the extension belt to engage the lock arm at the right moment, the rafter arms may be damaged or not fully extended. The sloppy connection provides an automatic correction for such a circumstance.

A stop member 94 (FIG. 2A) is positioned at the connection between the inner and outer rafter arm sections 62 and 64, respectively, which prevents a perfect longitudinal alignment of the rafter arm sections and thereby also prevents an over-centered relationship of the rafter arm sections so that when the awning is retracted, the rafter arms will automatically drop or collapse at their pivotal connection 66 in a downward and desired direction. When the awning is to be retracted, the motor is energized to rotate the drive shaft in an opposite direction which causes the awning sheet to be wrapped around the roll bar and causes the extension belt to unwind from the drive spool, which moves the slide engagement member away from the associated end of the lock arm, thereby releasing the lock arm and allowing the rafter arm to collapse in a downward direction. Also, as the extension belt is unwound from the drive spool, the inward swinging movement of the roll bar toward the support structure causes the inner and outer sections of the support arms to telescopically collapse thereby shortening the effective length of the support arms. Once the awning is fully retracted with the roll bar and support arms immediately adjacent to the support structure, the overload switch built into the electric motor again de-energizes the motor in a conventional manner to prevent further rotation of the roll bar.

Figure 13:
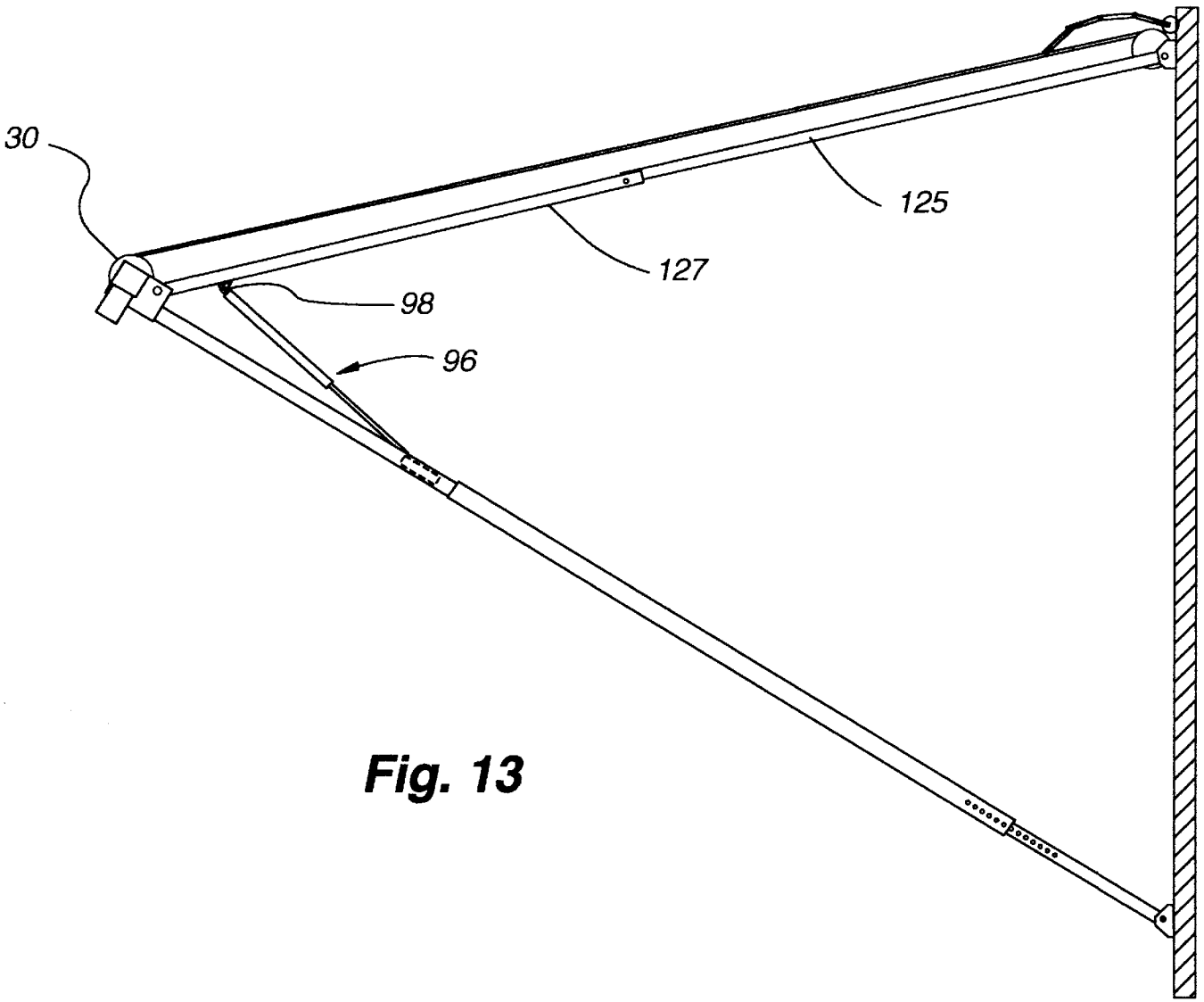
FIG. 13 is a side elevation of a second embodiment of the awning of the present invention.
Figure 14:
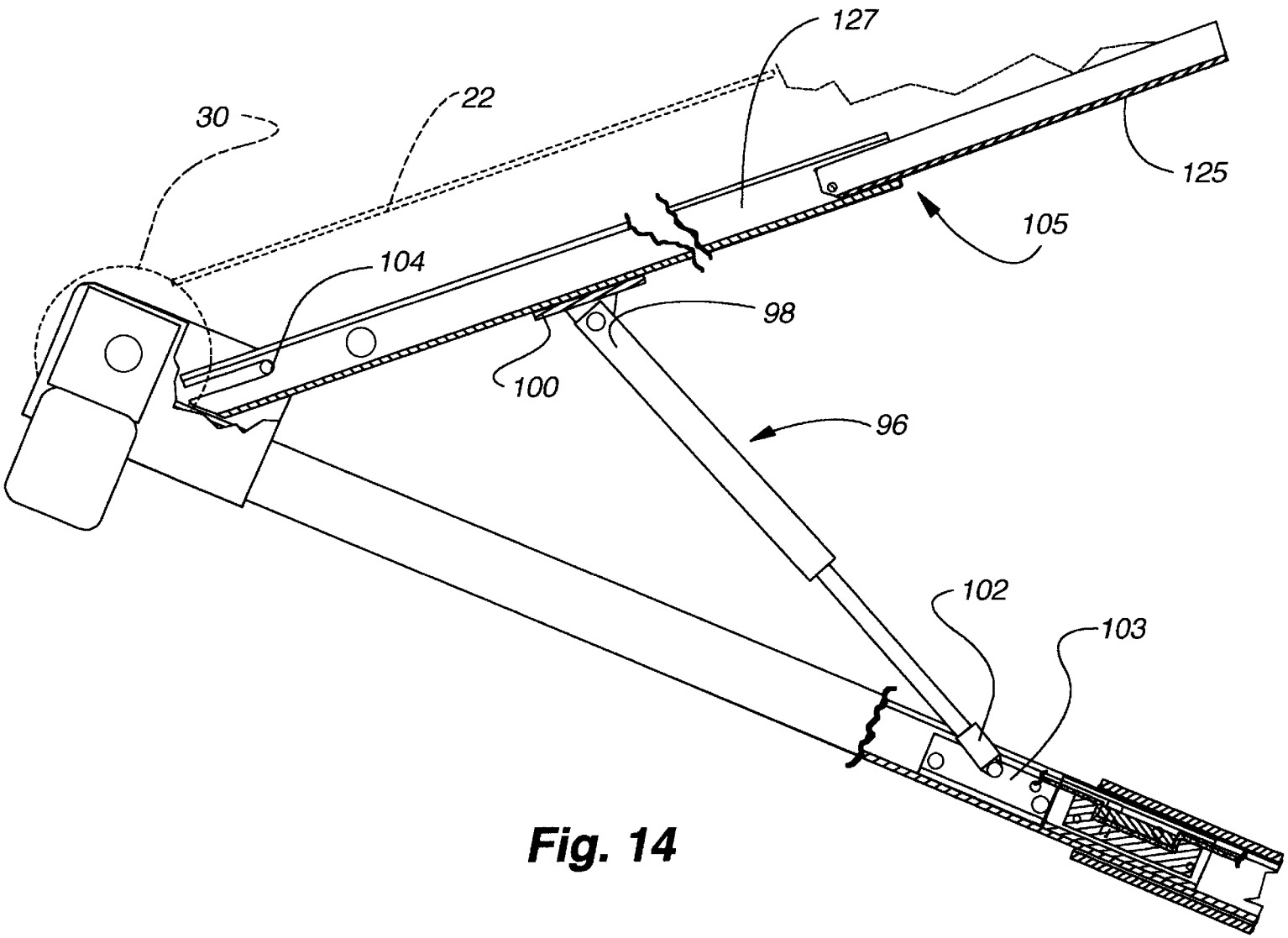
FIG. 14 is an enlarged fragmentary side elevation with parts removed of the connection between the support arm and rafter arm of the awning shown in FIG. 13.
Figure 14A:
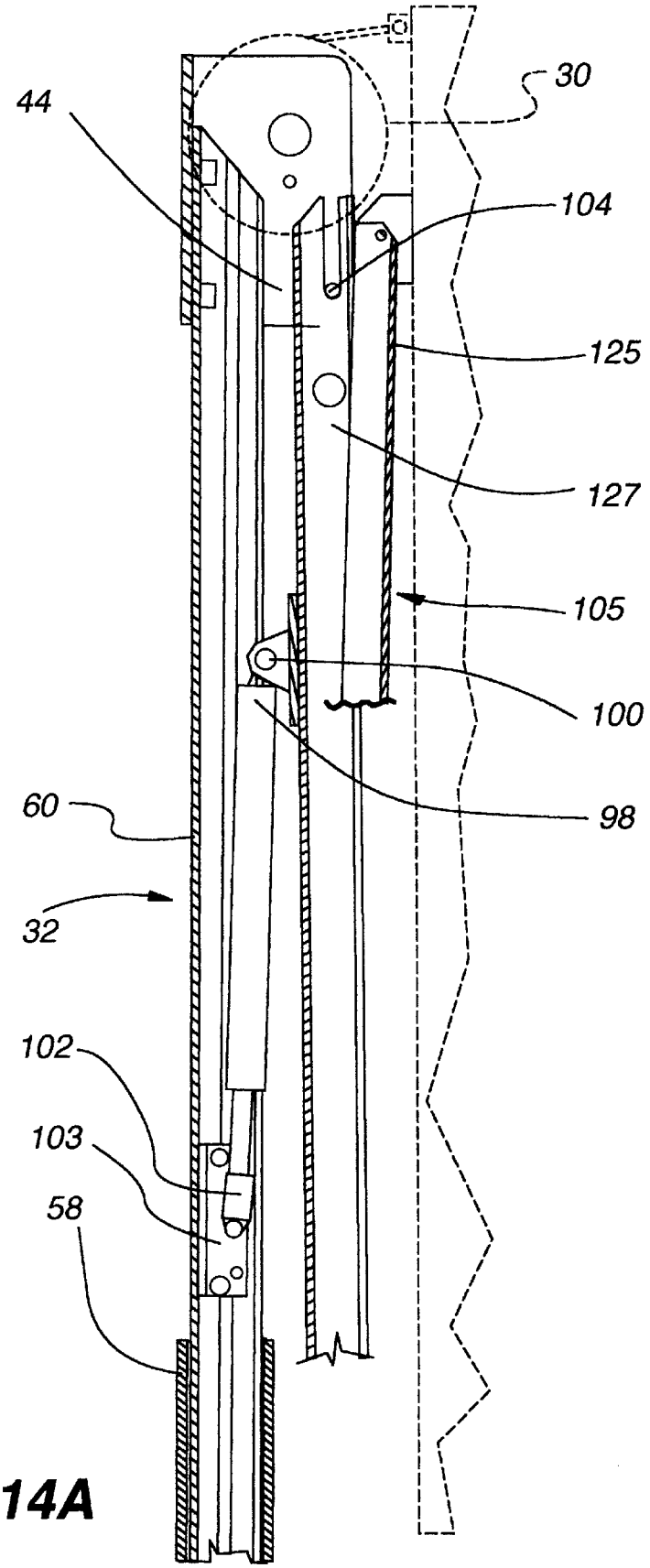
FIG. 14A is a fragmentary vertical section taken through the awning at the location where the rafter arm and support arms are joined to the roll bar.

In an alternative embodiment shown in FIGS. 13 and 14, the lock arm 68 is replaced with a lock arm in the form of a gas spring 96 wherein the cylinder end 98 of the gas spring is pivotally connected to a bracket 100 on the underside and near the outer end of the rafter arm 40 and the opposite or plunger end 102 of the gas spring is pivotally connected to a slide bracket 103 slidably disposed and confined within the associated support arm. In other words, the cylinder body is pivotally connected to the bracket 100 on the rafter arm while the plunger is pivotally connected to the slide bracket 103 in the support arm. The slide bracket is aligned with the slide engagement member 92 (not shown in FIGS. 13 and 14) described previously so that as the slide engagement member is moved outwardly toward the outer end of the support arm as described in connection with the first embodiment, it engages the slide bracket 103 forcing the slide bracket to move outwardly as well. When the slide engagement member initially engages the slide bracket, the gas spring is in its normal fully extended position. Further outward movement of the slide engagement member 92 forces the slide bracket 103 and plunger outwardly causing the gas spring to compress and simultaneously forcing the associated rafter arm up and away from the support arm until the rafter arm segments are substantially in longitudinal alignment and the gas spring is fully compressed (not shown). It is not imperative in this embodiment that the rafter arm segments not become aligned or even go over center as the gas springs forcefully fold or collapse the arms downwardly as the awning is retracted.

Also in the alternative embodiment, the coil spring 52 has been removed and the anchor pin 50 which was previously mounted on the rafter arm and slidably disposed in aligned slots 46 of the bracket 44 has been changed. In the alternative embodiment, an anchor pin 104 similar to pin 50 is mounted on the bracket 44 and slidably disposed in aligned slots in the rafter arm as clearly seen in FIG. 14. This again provides for a sloppy connection between the rafter arm and support arm for the same purpose mentioned with regard to the first described embodiment.

As will be appreciated, when the awning is retracted and the slide engagement member moves in a reverse direction toward the inner end of the support arm, the slide bracket 103 will follow the slide engagement member until the gas spring is fully extended in the position shown in FIG. 14. The rafter arm is thereby forcefully folded downwardly into its fully retracted position relative to the support arm.

Either of the above-described embodiments of the present invention can be further modified by incorporating a switching system into the awning so that in inclement weather conditions, the awning automatically retracts from its extended position. For purposes of the present disclosure, the switching system is described and illustrated as being incorporated into the second previously described embodiment even though it should be understood that the switching system could be incorporated into either of the previously described embodiments albeit with the best results being obtained with the second described embodiment.

Figure 15:
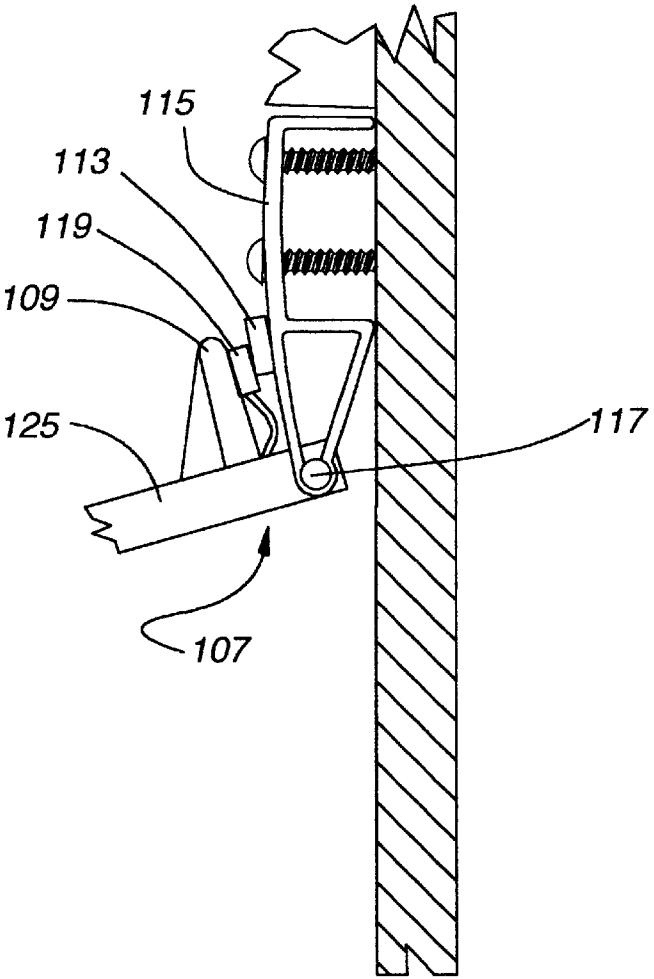
FIG. 15 is a fragmentary section taken through the support surface showing a mounting bracket and electrical switch for automatically operating a third embodiment of the awning of the present invention and wherein the switch is in a contacting position.
Figure 16:
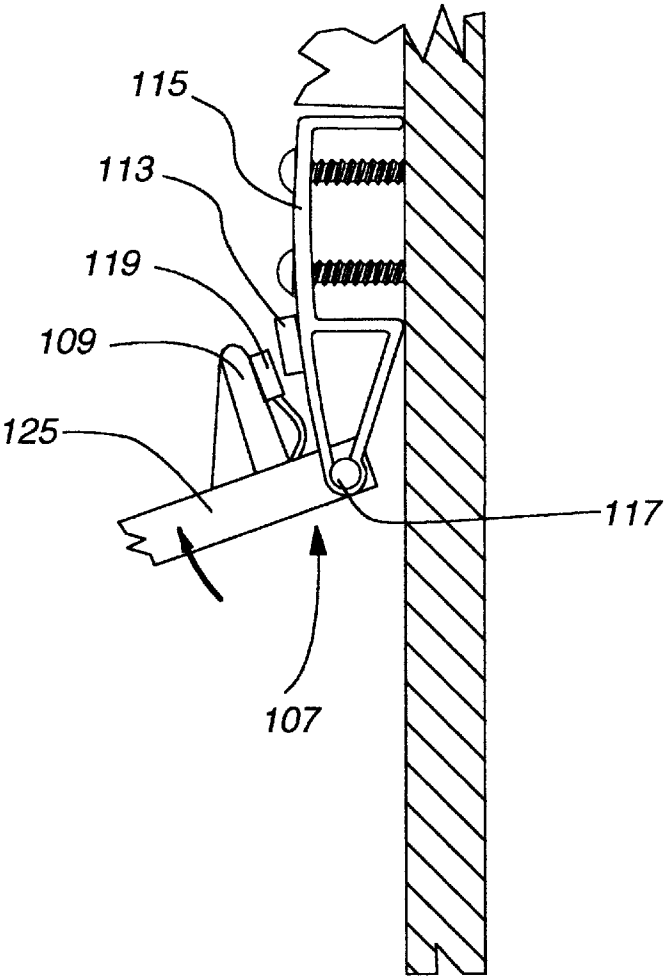
FIG. 16 is a fragmentary section similar to FIG. 15 with the switch in a non-contacting position.
Figure 17:
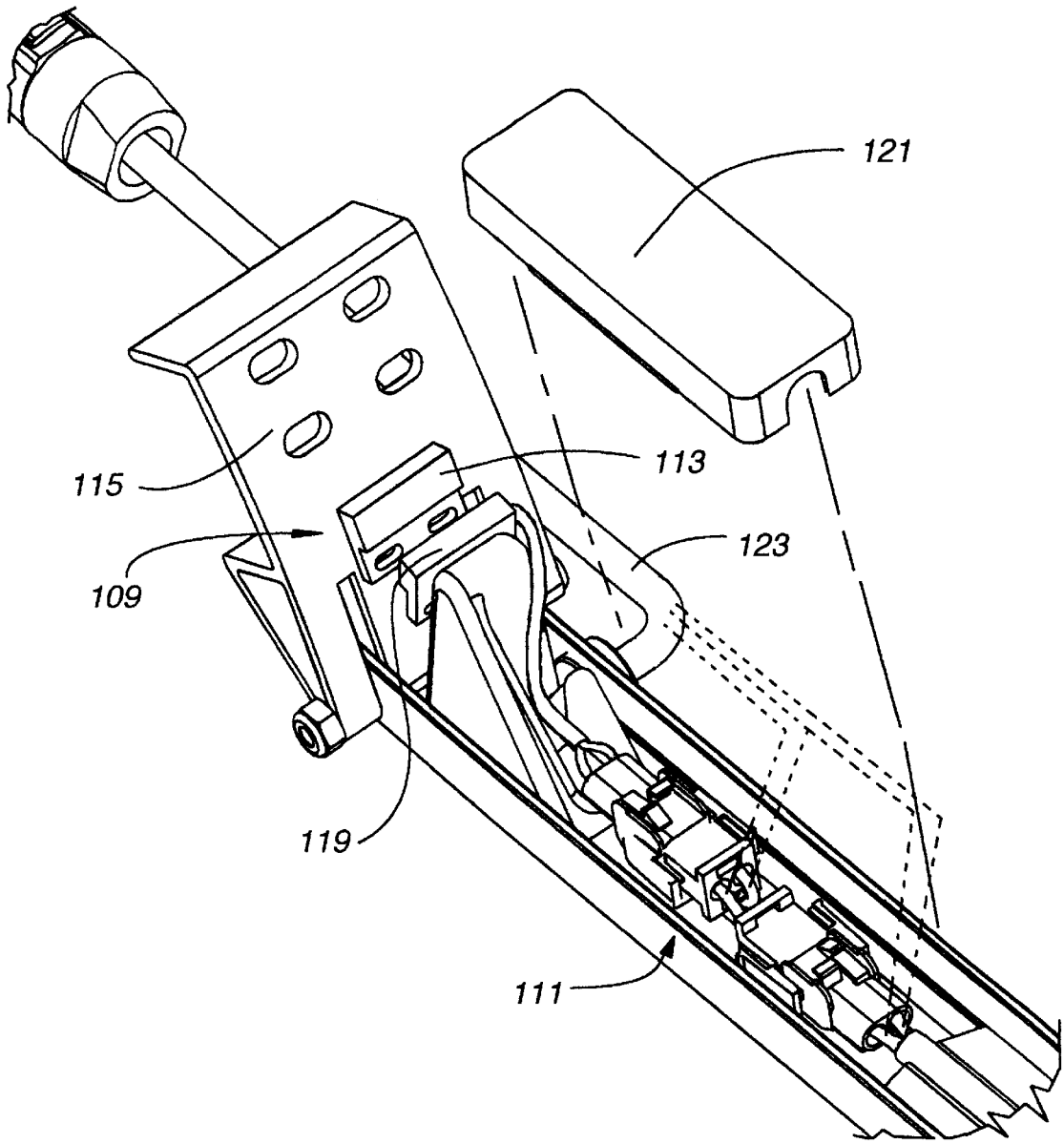
FIG. 17 is a fragmentary and exploded isometric view showing the end of a rafter arm where it is connected to the support bracket and illustrating the associated electrical switch.
Figure 18:
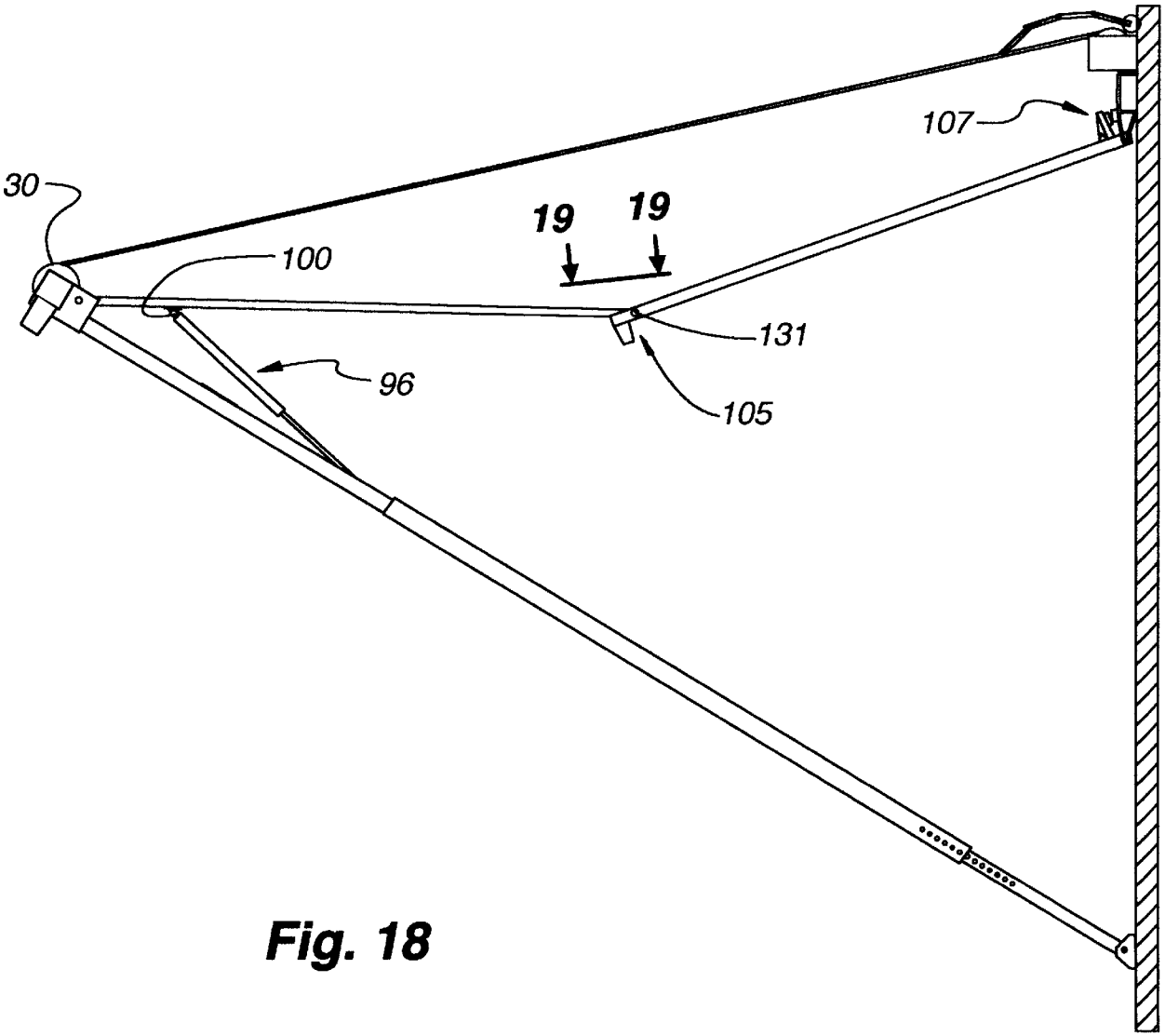
FIG. 18 is a side elevation of the third embodiment of the awning of the present invention wherein the electrical switch is provided for automatic operation of the awning.

Looking first at FIG. 18, the awning is substantially identical to the awning illustrated in FIGS. 13 and 14 except that the rafter arm 105 associated with the end of the awning that carries the drive motor 56 has been slightly modified to incorporate a switching system 107. The switching system 107 includes an electrical switch 109 (shown in more detail in FIGS. 15–17) that is electrically wired to the drive motor to energize the drive motor in a direction to retract the awning under predetermined conditions. The electrical components 111 for connecting the electrical switch 109 with the drive motor are shown in FIGS. 15–17, but a detailed description thereof will not be made as it would be evident to one skilled in the electrical arts. Suffice it to say that all embodiments of the present invention include a continuous manually operable rocker switch (not shown), which is electrically wired to the drive motor 56, so that an operator of the awning can hold the rocker switch in an extending position or in a retracting position to move the awning between the extended and retracted positions, respectively, in accordance with the above descriptions of the awnings. With the awning illustrated in FIGS. 15–21, however, the electrical switch 109, which is in the form of a reed switch, is incorporated into the awning in a manner so as to automatically position the rocker switch in its retracting position under certain conditions as will be described hereafter.

The reed switch 109 is a magnetic reed switch having a magnet 113 mounted on a mounting bracket 115 on the support structure for the awning with the mounting bracket being best illustrated in FIGS. 15–17. The mounting bracket has a pivotal connection at 117 for the inner end of the associated rafter arm 105 and carries the magnet 113 on the outer surface of the bracket above the pivotal connection location. The reed switch is mounted on the top surface of the inner end of the rafter arm and has a contact pad 119 adapted to engage the magnet 113 when the awning is fully extended as in FIG. 15. When the reed switch contact pad 119 is engaged with the magnet, 113 the switch is open but should the engagement be broken as shown in FIG. 16, the switch closes and a circuit is completed to the retracting position of the rocker switch so as to activate the drive motor to retract the awning.

Figure 19:
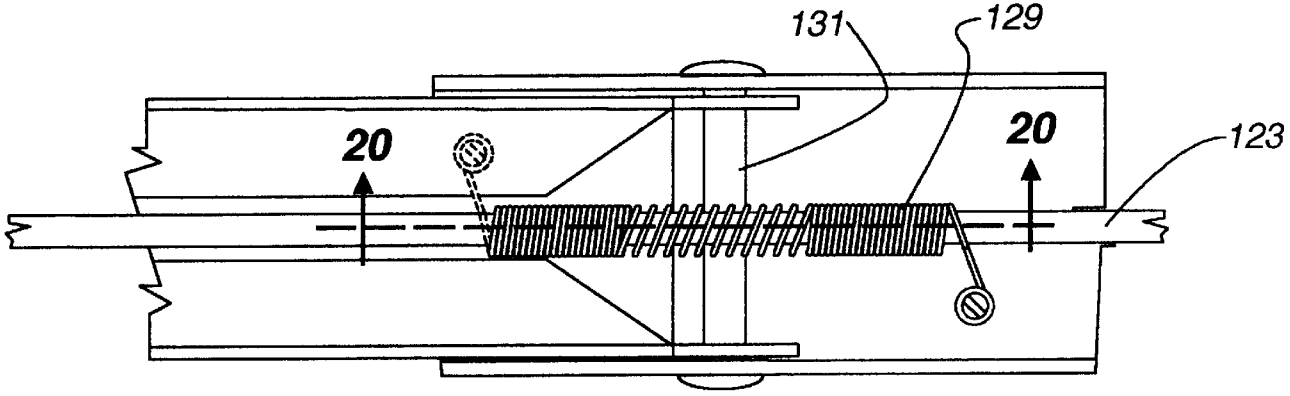
FIG. 19 is an enlarged view taken along line 19—19 of FIG. 18.
Figure 20:
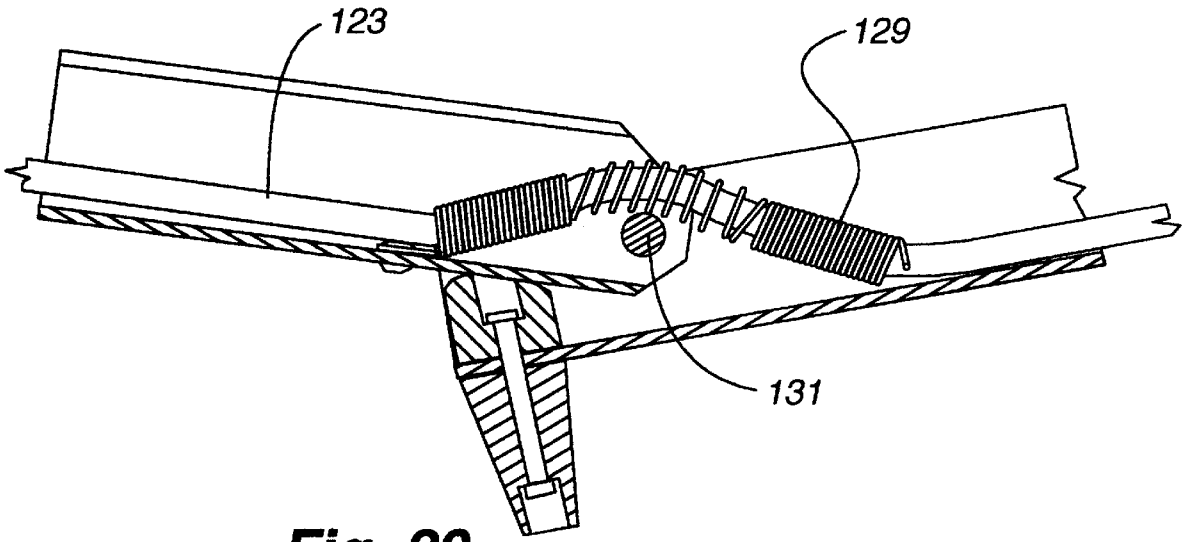
FIG. 20 is a section taken along line 20—20 of FIG. 19.

Looking more particularly at FIG. 17, the mounting bracket 115 for the rafter arm is illustrated with the inner end of the associated rafter arm 105 pivotally connected thereto and it will be appreciate that the rafter arm is channel shaped and opens upwardly so as to receive the electrical components 111 of the system. A cover plate 121 overlies the electrical components and is releasably secured in place in any suitable manner. A power supply line 123 coming from a power source (not shown) and the support structure 26 is connected to the electrical components 111 for operation of the device as described above. As will be appreciated, the power line 123 runs along the associated rafter arm 105 within the inner and outer channel segments 125 and 127, respectively, of the rafter arm so as to be connected to the drive motor 56 for operation of the drive motor. At the elbow or the pivotal location where the inner and outer rafter arm segments 125 and 127, respectively, are connected, the electrical power line is encased in a coil spring 129 as seen in FIGS. 19 and 20, and passes over a pivot pin 131 connecting the inner and outer segments of the rafter arm. The coil spring, of course, is provided to protect the power line from damage during repeated extensions and retractions of the awning.

Figure 21:
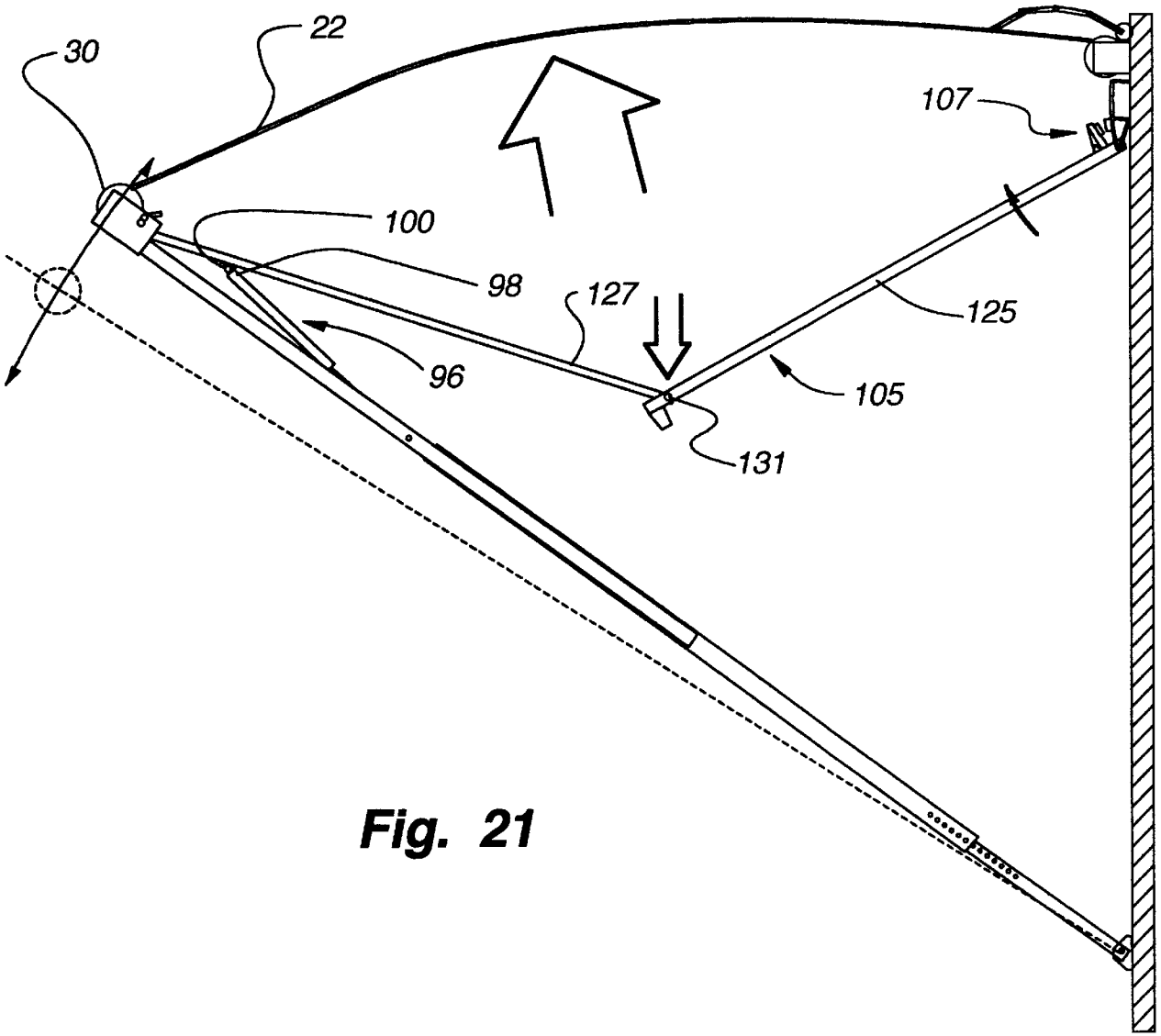
FIG. 21 is a diagrammatic side elevation showing the third embodiment of the awning of the present invention being moved from an extended to a retracted position.

The awning has been designed so that in inclement weather, such as high winds, if a draft of wind gets under the awning canopy 22, as illustrated in FIG. 21, thereby lifting or bellowing the awning canopy upwardly, the canopy pulls the roll bar 30 inwardly toward the support structure 26 against the bias of the gas spring 96, which causes the rafter arm to fold or collapse downwardly. When the arm folds or collapses downwardly, the reed switch 109 is activated by breaking its engagement with the magnet 113 thereby energizing the retracting position of the rocker switch that causes the drive motor to rotate the roll bar in a direction to wrap the canopy therearound thereby moving the awning from the extended to the retracted position. It will be appreciated that an automatic retract system as described would not function as effectively with the first described embodiment of the present invention inasmuch as the brace arm prevents the rafter arms from folding downwardly until the awning canopy begins to wrap around the roll bar. The gas spring arrangement, however, permits ready downward folding of the rafter arm so that the automatic retract system works more effectively with the second described embodiment of the invention than with the first embodiment.

Although the present invention has been described with a certain degree of particularity, it is understood that the present disclosure has been made by way of example, and changes in detail or structure may be made without departing from the spirit of the invention as defined in the appended claim.

What is claimed is:

1. A powered retractable awning for mounting on a support structure for movement between extended and retracted positions comprising in combination:

an awning sheet having one edge operably secured to said support structure, an elongated roll bar secured to an opposite edge of said awning sheet and around which the awning sheet is wrapped in the retracted position of the awning, a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar, a drive shaft extending longitudinally of said roll bar and a motor operably connected to the drive shaft to selectively rotate the drive shaft in opposite directions, said drive shaft having drive spools thereon associated with each support arm for unitary rotation therewith, a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm, and an extendable belt system for extending the length of said support arms, said belt system having a belt associated with and connected at one end to each of said drive spools and operably connected to an outer section of an associated support arm such that rotation of said drive shaft in one direction causes the awning sheet to unwrap from said roll bar while simultaneously extending the support arms and rafter arms, and rotation of the drive shaft in the opposite direction causes the awning sheet to be wrapped around said roll bar while simultaneously shortening said support arms and rafter arms, said belt system further including an idler roller mounted on said outer section of each support arm, said belt passing around the associated idler roller and being fixedly secured at a second end to the inner section of the associated support arm and wherein rotation of said drive spool in one direction causes the associated belt to be wrapped therearound thereby pulling the outer section of the associated support arm outwardly relative to the inner section of the associated support arm to thereby extend the length of the support arm.

2. The awning of claim 1 wherein said idler roller is always further away from said drive spool than the location at which the second end of the belt is secured to said inner section of the support arm.

3. The awning of claim 1 further including a stop for preventing longitudinal alignment of said inner and outer sections of the rafter arms.

4. The awning of claim 1 further including a brace extending between a support arm and an associated rafter arm for forcing a predetermined spacing between the support arm and the associated rafter arm when the awning is extended.

5. The awning of claim 4 further including activating means for moving said brace into a position to maintain said predetermined spacing.

6. The awning of claim 5 wherein said activating means includes a slide secured to said belt and adapted to move said brace into said position for maintaining said predetermined spacing as said support arm is extended by said belt.

7. The awning of claim 6 wherein said brace is pivotally connected at one end to said associated rafter arm and is operatively engageable by said slide at an opposite end.

8. The awning of claim 7 wherein said brace is rigid.

9. The awning of claim 7 wherein said brace is a gas spring.

10. The awning of claim 1 wherein said rafter arm sections are longitudinally aligned when said awning is fully extended.

11. The awning of claim 7 wherein said opposite end of said brace is slidingly engaged with said support arm.

12. The awning of claim 1 further including a manually operable switch electrically connected to said motor for reversibly operating said motor.

13. The awning of claim 12 further including a motion detecting switch electrically connected to said motor for energizing said motor to retract the awning from its extended position under predetermined conditions.

14. The awning of claim 13 wherein said motion detecting switch is operably connected to a rafter arm for detecting movement in the rafter arm.

15. The awning of claim 14 wherein said motion detecting switch is magnetically activated read switch.

16. The awning of claim 14 wherein said motion detecting switch detects a folding of the associated rafter arm from its position when the awning is fully extended.

17. A retractable awning for mounting on a support structure for movement between extended and retracted positions comprising in combination:

an awning sheet having one edge operably secured to said support structure;

an elongated roll bar secured to an opposite edge of said awning sheet and around which the awning sheet is wrapped in the retracted position of the awning;

a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar;

a drive spool mounted on said roll bar at each end thereof for unitary rotation therewith;

a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm; and an extensible belt system for extending the length of said support arms, said belt system having a belt associated with and connected at one end to each of said drive spools and operably connected to an outer section of an associated support arm such that rotation of said drive spool in one direction causes the awning sheet to unwrap from said roll bar while simultaneously extending the support arms and rafter arms, and rotation of the drive spool in the opposite direction causes the awning sheet to be wrapped around said roll bar while simultaneously shortening said support arms and rafter arms an idler roller mounted on said outer section of each support arm, said belt passes around the associated idler roller and is fixedly secured at a second end to the inner section of the associate support arm and wherein rotation of said drive spool in one direction causes the associated belt to be wrapped therearound thereby pulling the outer section of the associated support outwardly relative to the inner section of the associated support arm to thereby extend the length of the support arm.

18. The awning of claim 17 wherein said idler spool is always further away from said drive spool than the location at which the second end of the belt is secured to said inner section of the support arm.

19. The awning of claim 17 further including a stop for preventing longitudinal alignment of said inner and outer sections of the rafter arms.

20. The awning of claim 17 further including a brace extending between a support arm and an associated rafter arm for forcing a predetermined spacing between the support arm and the associated rafter arm when the awning is extended.

21. The awning of claim 20 further including activating means for moving said brace into a position to maintain said predetermined spacing.

22. The awning of claim 21 wherein said activating means includings a slide secured to said belt and adapted to move said brace into said position for maintain said predetermined spacing as said support arms are extended by said belt.

23. The awning of claim 22 wherein said brace is pivotally connected at one end to said associated rafter arm and is operably engageable by said slide at an opposite end.

24. The awning of claim 23 wherein said brace is rigid.

25. The awning of claim 23 wherein said brace is a gas spring.

26. The awning of claim 7 wherein said rafter arm sections are longitudinally aligned when said awning is fully extended.

27. The awning of claim 23 wherein said opposite end of said brace is slidingly engaged with said support arm.

28. A powered retractable awning for mounting on a support structure for movement between extended and retracted positions comprising in combination:

an awning sheet having one edge operably secured to said support structure, an elongated roll bar secured to an opposite edge of said awning sheet and around which the awning sheet is wrapped in the retracted position of the awning, a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar, a drive shaft extending longitudinally of said roll bar and a motor operably connected to the drive shaft to selectively rotate the drive shaft in opposite directions, said drive shaft having drive spools thereon associated with each support arm for unitary rotation therewith, a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm, and an extendable belt system for extending the length of said support arms, said belt system having a belt associated with and connected at one end to each of said drive spools and operably connected to an outer section of an associated support arm such that rotation of said drive shaft in one direction causes the awning sheet to unwrap from said roll bar while simultaneously extending the support arms and rafter arms, and rotation of the drive shaft in the opposite direction causes the awning sheet to be wrapped around said roll bar while simultaneously shortening said support arms and rafter arms, said belt system further including an idler roller mounted on said outer section of each support arm, said belt passing around the associated idler roller and being secured at a second end to the inner section of the associated support arm and wherein rotation of said drive spool in one direction causes the associated belt to be wrapped therearound thereby pulling the outer section of the associated support arm outwardly relative to the inner section of the associated support arm to thereby extend the length of the support arm, wherein said idler roller is always further away from said drive spool than the location at which the second end of the belt is secured to said inner section of the support arm and wherein said idler roller is slidably mounted on said outer section of the support arm and further including biasing means for biasing said idler roller away from said drive spool.

29. The awning of claim 28 further including a stop on said outer section of the support arm to limit the sliding movement of the idler roller toward said drive spool.

30. A retractable awning for mounting on a support structure for movement between extended and retracted positions comprising in combination:

an awning sheet having one edge operably secured to said support structure an elongated roll bar secured to an opposite edge of said awning sheet and around which the awning sheet is wrapped in the retracted position of the awning;

a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar;

a drive spool mounted on said roll bar at each end thereof for unitary rotation therewith;

a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm; and an extendable belt system for extending the length of said support arms, said belt system having a belt associated with and connected at one end to each of said drive spools and operably connected to an outer section of an associated support arm such that rotation of said drive spool in one direction causes the awning sheet to unwrap from said roll bar while simultaneously extending the support arms and rafter arms, and rotation of the drive spool in the opposite direction causes the awning sheet to be wrapped around said roll bar while simultaneously shortening said support arms, rafter arms and idler roller mounted on said outer section of each support arm, said belt passing around the associated idler roller and being secured at a second end to the inner section of the associated support arm and wherein rotation of said drive spool in one direction causes the associated belt to be wrapped around thereby pulling the outer section of the associated support arm outwardly relative to the inner section of the associated support arm to thereby extend the length of the support arm, wherein said roller is always further away from said drive spool than the location at which the second end of the belt is secured to said inner section of the support arm and wherein said roller is slidably mounted on said outer section of the support arm and further including biasing means for biasing said idler roller away from said drive spool.

31. The awning of claim 30 further including a stop on said outer section of the support arm to limit the sliding movement of the idler roller towards a drive spool.

32. A powered retractable awning for mounting on a support structure for movement between extended and retracted positions comprising in combination:

an awning sheet having one edge operably secured to said support structure, an elongated roll bar secured to an opposite edge of said awning sheet and around which the awning sheet is wrapped in the retracted position of the awning, a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar, a drive shaft extending longitudinally of said roll bar and a motor operably connected to the drive shaft to selectively rotate the drive shaft in opposite directions, said drive shaft having drive spools thereon associated with each support arm for unitary rotation therewith, a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm, and an extendable belt system for extending the length of said support arms, said belt system having a belt associated with and connected at one end to each of said drive spools and operably connected to an outer section of an associated support arm such that rotation of said drive shaft in one direction causes the awning sheet to unwrap from said roll bar while simultaneously extending the support arms and rafter arms, and rotation of the drive shaft in the opposite direction causes the awning sheet to be wrapped around said roll bar while simultaneously shortening said support arms and rafter arms.

a brace extending between a support arm and an associated rafter arm for forcing a predetermined spacing between the support arm and the associated rafter arm when the awning is extended, and further including activating means for moving said brace into a position to maintain said predetermined spacing wherein said activating means includes a slide secured to said belt and adapted to move said brace into said position for maintaining said predetermined spacing as said support arm is extended by said belt and wherein said brace is pivotally connected at one end to said associated rafter arm and operatively engageable by said slide at an opposite end, said brace being in the form of gas spring and wherein said opposite end of said gas spring is pivotally attached to a second slide that is engageable by said first mentioned slide.

33. A retractable awning for mounting on a support structure for movement between extended and retracted positions comprising in combination:

an awning sheet having one edge operably secured to said support structure an elongated roll bar secured to an opposite edge of said awning sheet and around which the awning sheet is wrapped in the retracted position of the awning;

a pair of extensible support arms with one support arm being positioned at each end of the roll bar, each support arm including telescoping inner and outer sections, with an inner end of the inner section being pivotally and operably connected to said support structure and with an outer end of the outer section operably and rotatably supporting one end of said roll bar;

a drive spool mounted on said roll bar at each end thereof for unitary rotation therewith;

a pair of extensible rafter arms with a rafter arm associated with each support arm, each rafter arm having an inner and outer section with an outer end of the inner section being pivotally connected to an inner end of the outer section, an inner end of the inner section being pivotally connected to said support structure at a relatively high location in comparison to the connection of the support arms to the support structure, and an outer end of the outer section being operably and pivotally connected to the outer end of the outer section of an associated support arm; and an extendable belt system for extending the length of said support arms, said belt system having a belt associated with and connected at one end to each of said drive spools and operably connected to an outer section of an associated support arm such that rotation of said drive spool in one direction causes the awning sheet to unwrap from said roll bar while simultaneously extending the support arms and rafter arms, and rotation of the drive spool in the opposite direction causes the awning sheet to be wrapped around said roll bar while simultaneously shortening said support arms and rafter arms, a brace extending between a support arm and associated rafter arm for forcing a predetermined spacing between the sport arm and the associated rafter arm when the awning is extended, activating means for moving said brace into a position to maintain said predetermined spacing, said activating means including a slide secured to said belt and adapted to move said brace into said position for maintaining said predetermined spacing as the support arms are extended by said belt, wherein said brace is pivotally connected at one end to said associated rafter arm and operatively engageable by said slide at an opposite end, said brace being in the form of a gas spring wherein said opposite end of said gas spring is pivotally attached to a second slide that is engageable by said first mentioned slide.

* * * * *

UNITED STATES PATENT AND TRADEMARK OFFICE

CERTIFICATE OF CORRECTION

PATENT NO. : 6,341,638 B1
DATED : January 29, 2002
INVENTOR(S) : Scott P. Thompson et al.

It is certified that error appears in the above-identified patent and that said Letters Patent is hereby corrected as shown below:

Column 12,
Line 44, delete “associate” and insert -- associated --;
Line 47, after “support” insert -- arm --;
Line 51, delete “spool” and insert -- roller --; and
Line 67, delete “includings” and insert -- includes --.

Column 13,
Line 1, delete “maintain” and insert -- maintaining --; and
Line 9, delete “7” and insert -- 17 --.

Column 14,
Line 48, after “arms”, first occurence, delete “,” and insert -- and --;
Line 48, after “arms”, second occurence, delete “and” and insert -- , said belt system further including an --; and
Line 54, delete “around” and insert -- therearound --.

Signed and Sealed this

Twenty-second Day of October, 2002

*Attest:*

*Attesting Officer*

JAMES E. ROGAN
*Director of the United States Patent and Trademark Office*